US008267551B2

(12) United States Patent
Lin

(10) Patent No.: US 8,267,551 B2
(45) Date of Patent: Sep. 18, 2012

(54) LED ROAD LIGHT

(76) Inventor: Chiu-Min Lin, Guishan Township (TW)

( * ) Notice: Subject to any disclaimer, the term of this patent is extended or adjusted under 35 U.S.C. 154(b) by 216 days.

(21) Appl. No.: 12/901,377

(22) Filed: Oct. 8, 2010

(65) Prior Publication Data

US 2012/0087139 A1 Apr. 12, 2012

(51) Int. Cl.
*F21V 29/00* (2006.01)

(52) U.S. Cl. ..... 362/294; 362/249.02; 362/431

(58) Field of Classification Search ..... 362/217.01, 362/217.02, 217.04, 217.1, 217.12–217.17, 362/218, 219, 222, 223, 225, 227, 240, 244, 362/246, 249.01, 249.02, 249.11, 282, 285, 362/294, 309, 310, 326, 327, 335, 351, 362, 362/365, 370, 373–375, 395, 396, 410, 431, 362/432, 800

See application file for complete search history.

(56) References Cited

U.S. PATENT DOCUMENTS

| | | | | |
|---|---|---|---|---|
| 7,278,761 | B2 * | 10/2007 | Kuan | 362/294 |
| 7,641,363 | B1 * | 1/2010 | Chang et al. | 362/294 |
| 2007/0081338 | A1 * | 4/2007 | Kuan | 362/294 |
| 2009/0185374 | A1 * | 7/2009 | Wu et al. | 362/249.06 |
| 2010/0135008 | A1 * | 6/2010 | Teng | 362/227 |
| 2011/0194297 | A1 * | 8/2011 | Wu | 362/373 |

* cited by examiner

*Primary Examiner* — Hargobind S Sawhney
(74) *Attorney, Agent, or Firm* — Hershkovitz & Associates, LLC; Abraham Hershkovitz

(57) ABSTRACT

An LED road light has a heat sink embedded with an LED module, a base and a light pole holder assembly. The base, the heat sink and the light pole holder assembly are assembled by slidably and respectively mounting ribs into slots. Accordingly, the contact area of such engagement is relatively larger than that using screws, thereby enhancing combined strength and extending the life duration of the LED road light. Besides, the engagement mechanism using ribs and slots also provide workers a convenient and time-saving assembling process.

27 Claims, 7 Drawing Sheets

LED ROAD LIGHT

BACKGROUND OF THE INVENTION

1. Field of the Invention

The present invention relates to an LED road light, and more particularly to an LED road light assembled by engagements between ribs and slots formed on parts of the LED road light.

2. Description of the Related Art

With low power consumption and bright luminance, LED road lights have gradually become the mainstream road lights. Despite power-saving, the high heat issue is still a problem of the LED lights. Currently, a large heat dissipation board additionally mounted to an LED road light is a main technical measure to tackle the issue, but it also gives rise to assembling problems.

With reference to FIG. 6, a conventional LED road light has a top cover 50, a bottom cover 60 and an LED module 70.

The top cover 50 has a lamp pole sleeve 51 and two upper wings 52. The lamp pole sleeve 51 is formed on and protrudes from a rear end of the top cover 50. The two upper wings 52 are respectively formed on and protrude downwardly from two sides of the top cover 50. Each upper wing 52 has multiple through holes formed through the upper wing 52.

The bottom cover 60 has two lower wings 61, multiple light holes 612 and multiple screw holes 613. The two lower wings 61 are respectively formed on and protrude upwardly from two sides of the bottom cover 60. Each lower wing 61 has multiple through holes 611 formed through the lower wing 61. When the top cover 50 is mounted on the bottom cover 60 and the through holes 521 of the upper wings 52 respectively align with the through holes 611 of the lower wings 61, multiple bolts 80 are respectively mounted through the through holes 521, 621 to combine the top cover 50 and the bottom cover 60 together. The light holes 612 are formed through the bottom cover 60. The screw holes 613 are formed through the bottom cover 60 and are adjacent to the light holes 612.

The LED module 70 is mounted between the top cover 50 and the bottom cover 60 and has multiple LED strips 71. The LED strips 71 are parallel with each other and each LED strip 71 has a hollow metal bar 711 and multiple LED elements 712. The LED elements 712 are mounted in a bottom of the metal bar 711 and align with and respectively illuminate through the light holes 612. Each LED element 712 aligns with at least one of the screw holes 613 and is fastened on the bottom cover 60 by screwing multiple screws 713 into the LED element 712 through the screw holes 613.

As the LED module 70 of the conventional LED road light is combined with the bottom cover 60 with screws and the top cover is also fastened on the bottom cover by a screwing means, the conventional LED road light may be loosened and come off after a period of outdoor operation. Besides frequent maintenance, the risk of jeopardizing public safety is also high and the assembly of the conventional LED road light consumes labor-hours.

SUMMARY OF THE INVENTION

An objective of the present invention is to provide an LED road light assembled by using ribs and slots formed on parts of the LED road light and mounting ribs into corresponding slots to provide higher combined strength thereof and more convenient assembly process.

To achieve the foregoing objective, the LED road light a heat sink, an LED module, a base and a light pole holder assembly.

The heat sink has a top, a bottom, a light opening and multiple first sliding slots. The light opening is centrally formed through the heat sink. The first sliding slots are formed in the top of the heat sink.

The LED module is mounted to the light opening of the heat sink to illuminate downwardly through the light opening.

The base has a top, a bottom, multiple first sliding ribs and multiple second sliding slots. The first sliding ribs are formed on and protrude downwardly from the bottom of the base, and respectively align with and are slidably mounted in the first sliding slots on the top of the heat sink. The second sliding slots are formed in the top of the base.

The light pole holder assembly has a bottom and multiple second sliding ribs. The second sliding ribs are formed on and protrude downwardly from the bottom of the light pole holder assembly, and respectively align with and are slidably mounted in the second sliding slots on the top of the base.

The LED road light of the present invention employs ribs and slots formed on the base, the heat sink and the light pole holder to assembly those parts by slidably mounting the ribs into the corresponding sliding slots. Due to larger contact area of the engagement, the combined strength of the LED road light is relatively higher and thus results in more stable structure. Moreover, sliding mounting ribs into corresponding slots is convenient and time-saving for workers to assembly the LED road light.

Other objectives, advantages and novel features of the invention will become more apparent from the following detailed description when taken in conjunction with the accompanying drawings.

DETAILED DESCRIPTION OF THE INVENTION

Figure 1:
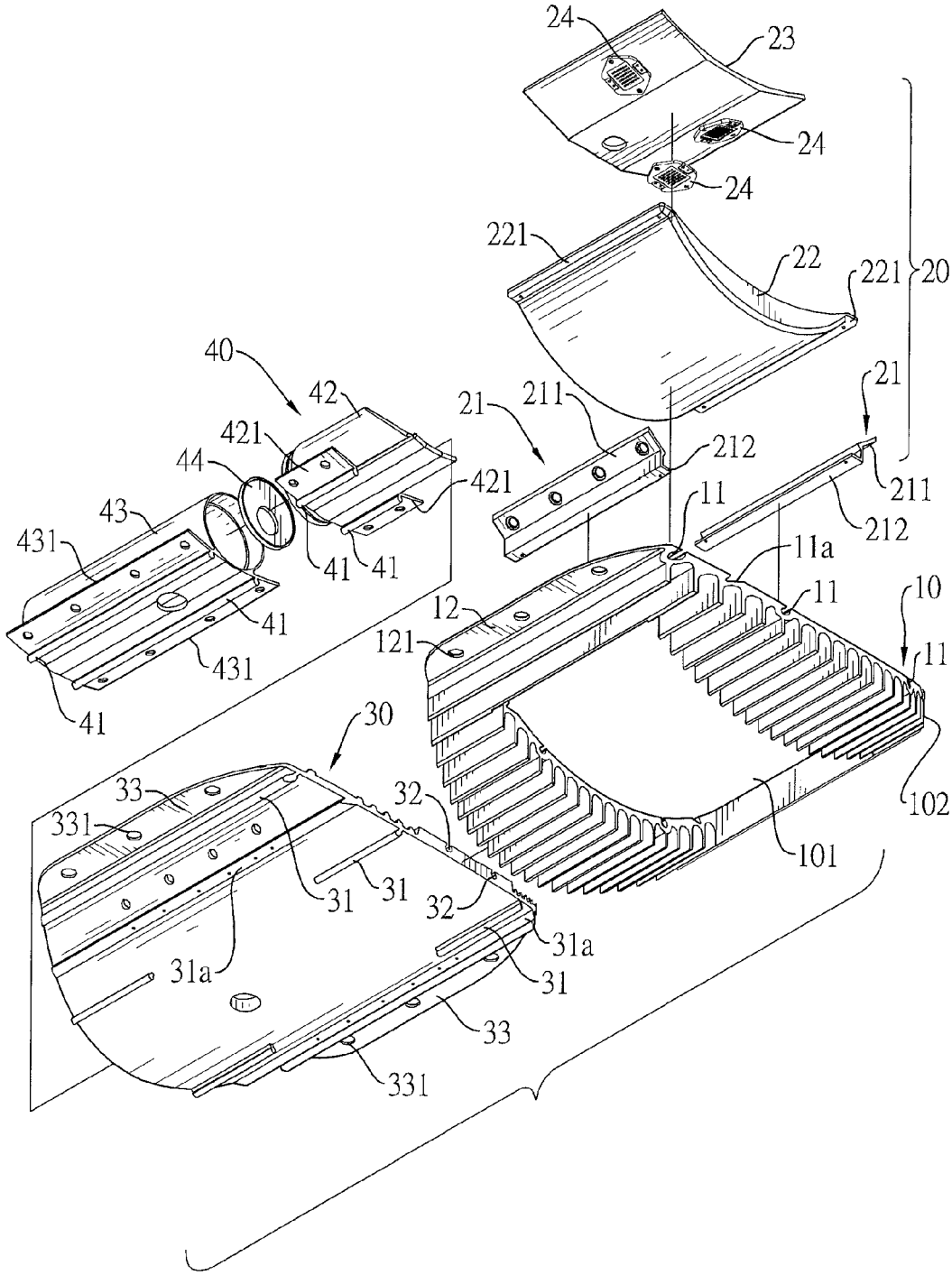
FIG. 1 is an exploded perspective view of a first embodiment of an LED road light in accordance with the present invention.
Figure 2:
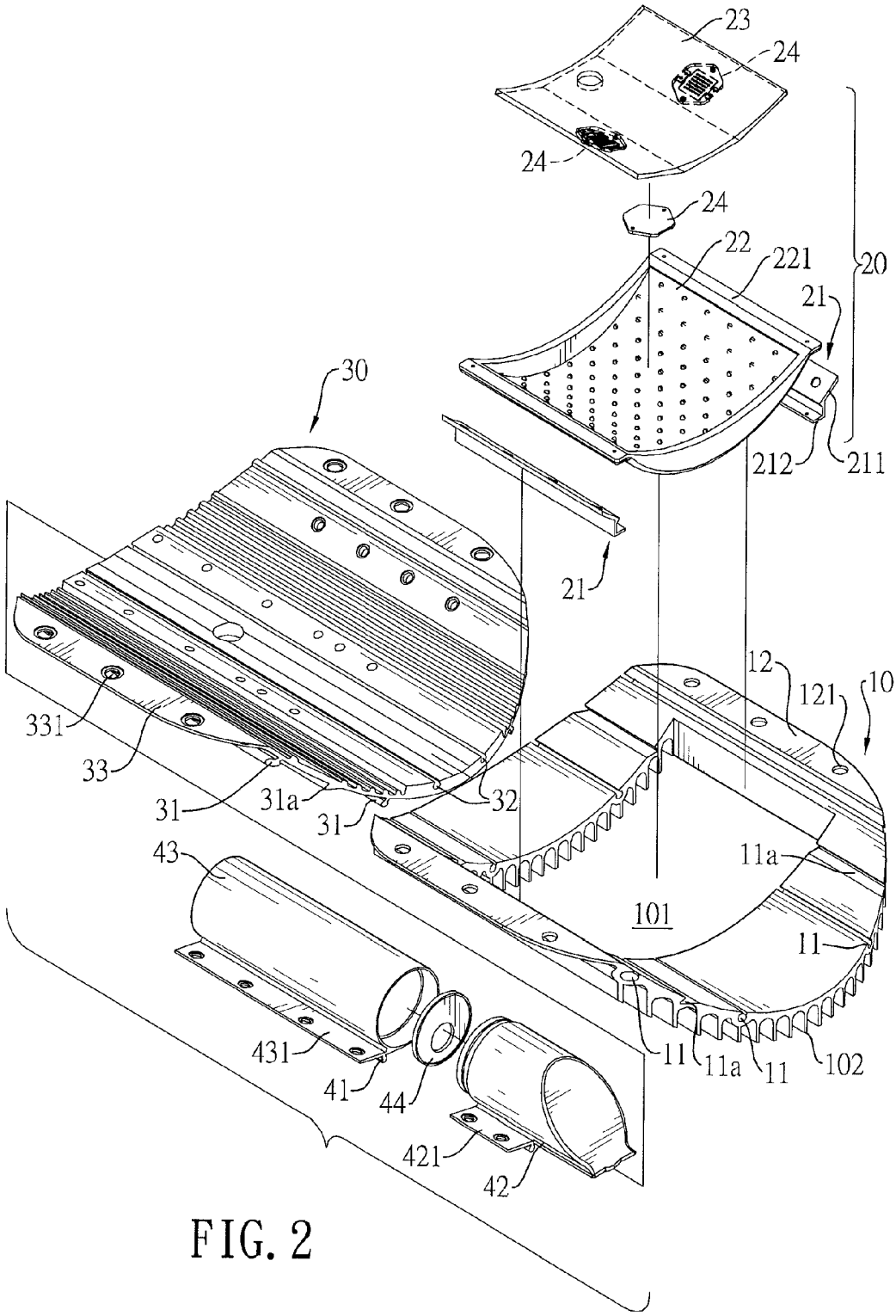
FIG. 2 another exploded perspective view of the LED road light in FIG. 1.
Figure 3:
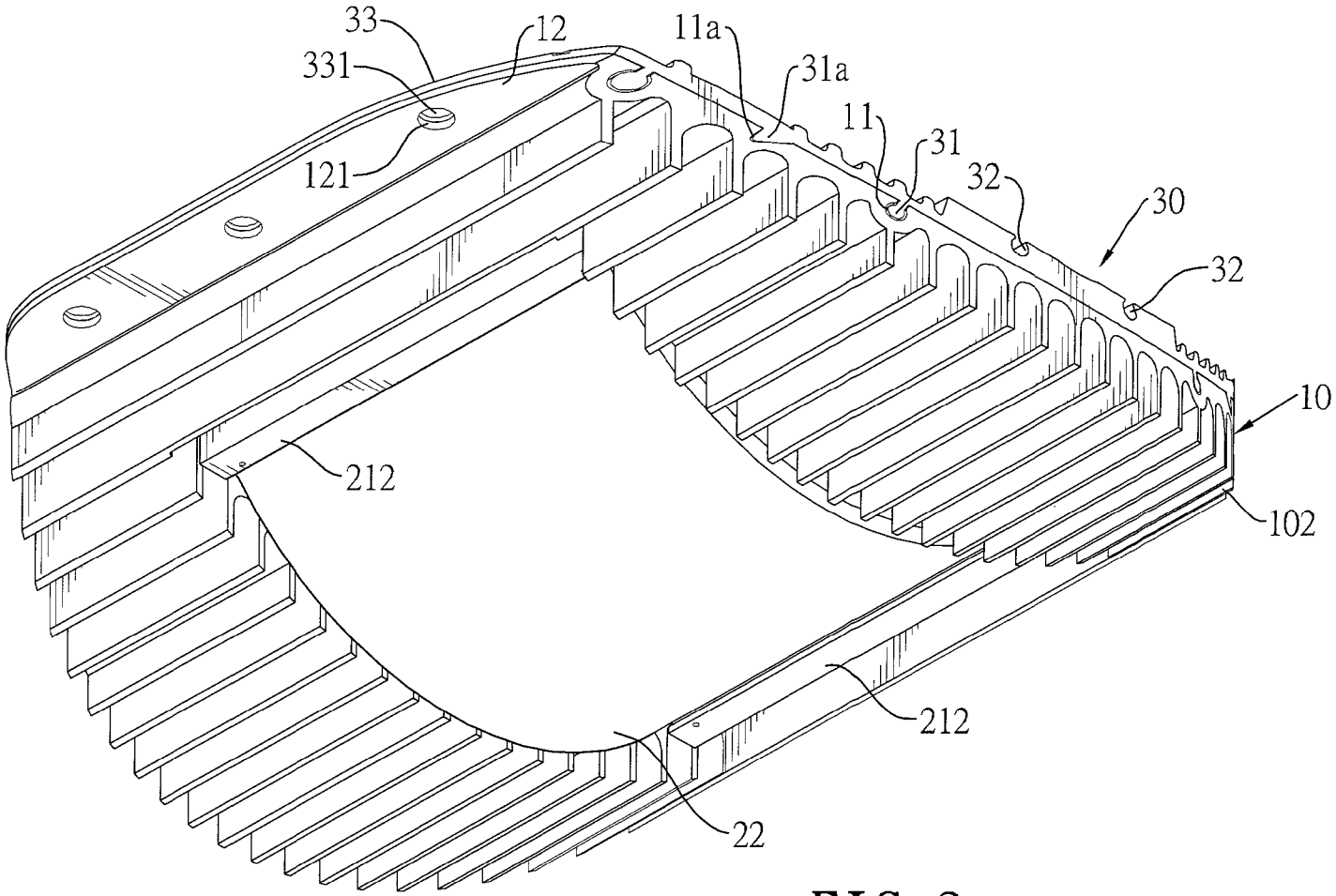
FIG. 3 is a perspective view of the LED road light in FIG. 1.

With reference to FIGS. 1 to 3, a first embodiment of an LED road light in accordance with the present invention has a heat sink 10, an LED module 20, a base 30 and a light pole holder assembly 40.

Figure 4A:
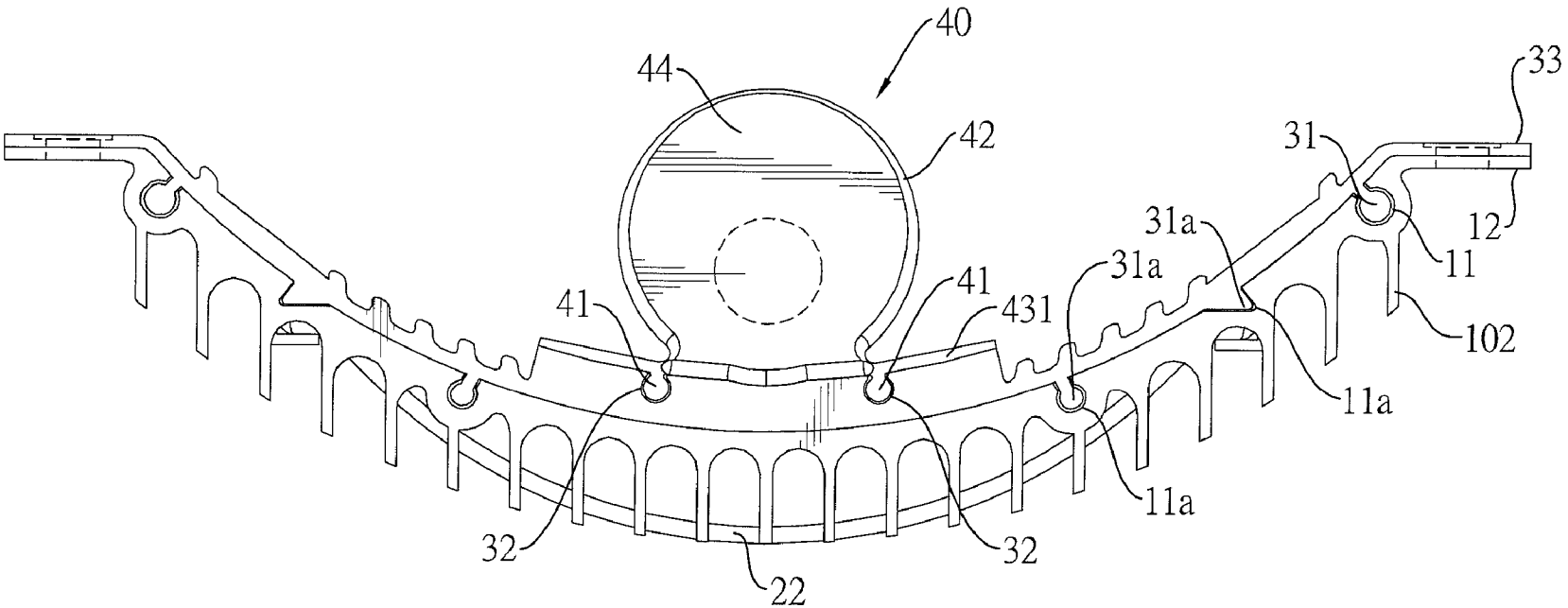
FIG. 4A is a side view of the LED road light in FIG. 1.
Figure 4B:
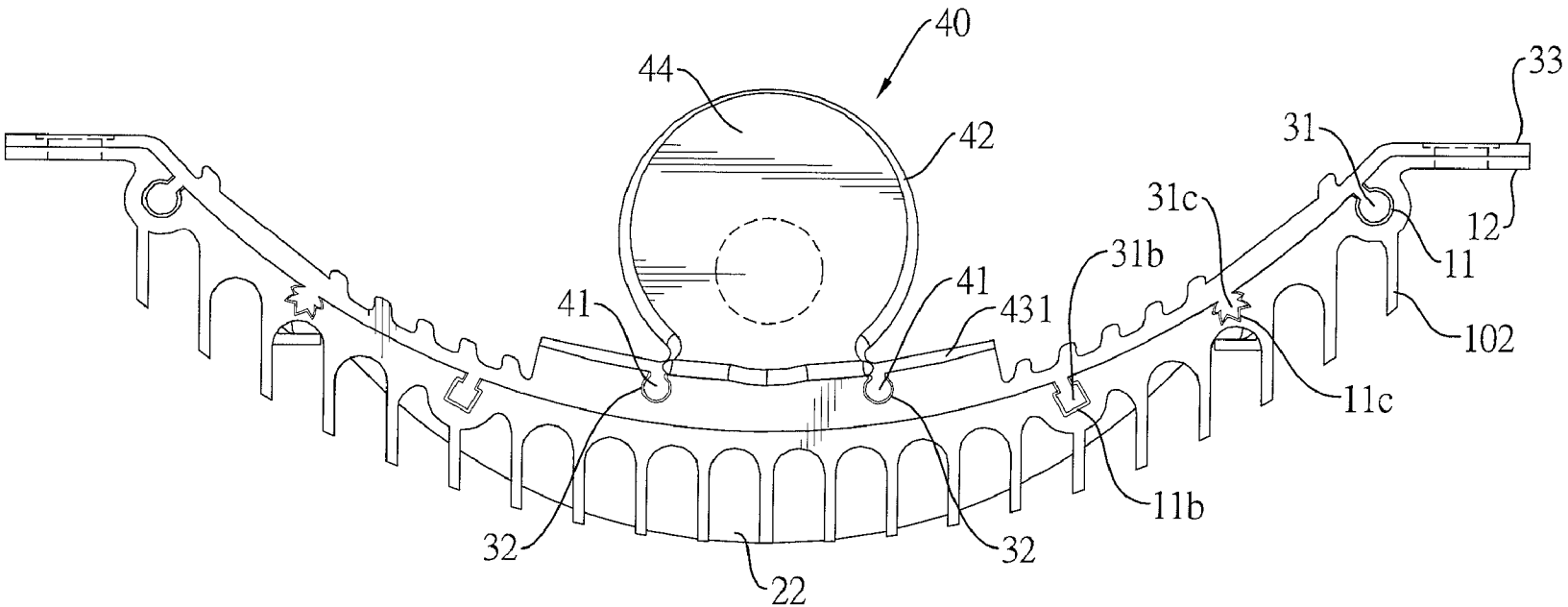
FIG. 4B is a side view of a second embodiment of an LED road light in accordance with the present invention.
Figure 5:
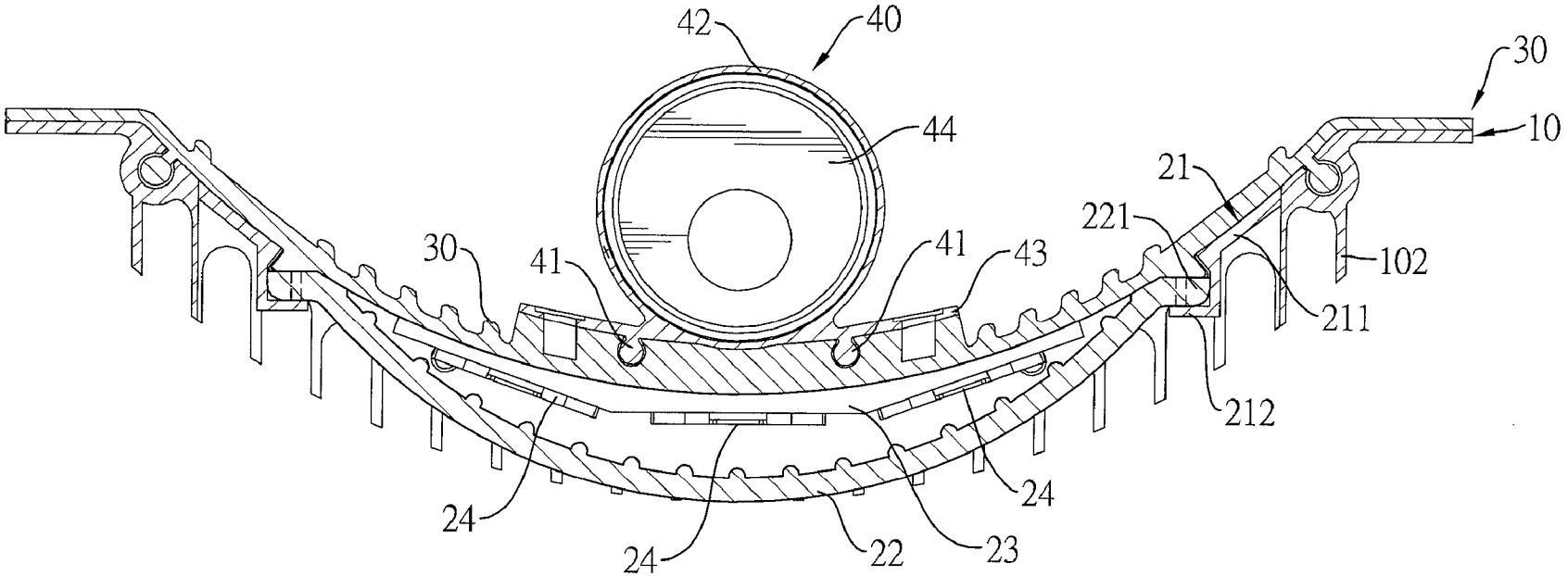
FIG. 5 is a cross-sectional side view of the LED road light in FIG. 1.
Figure 6:
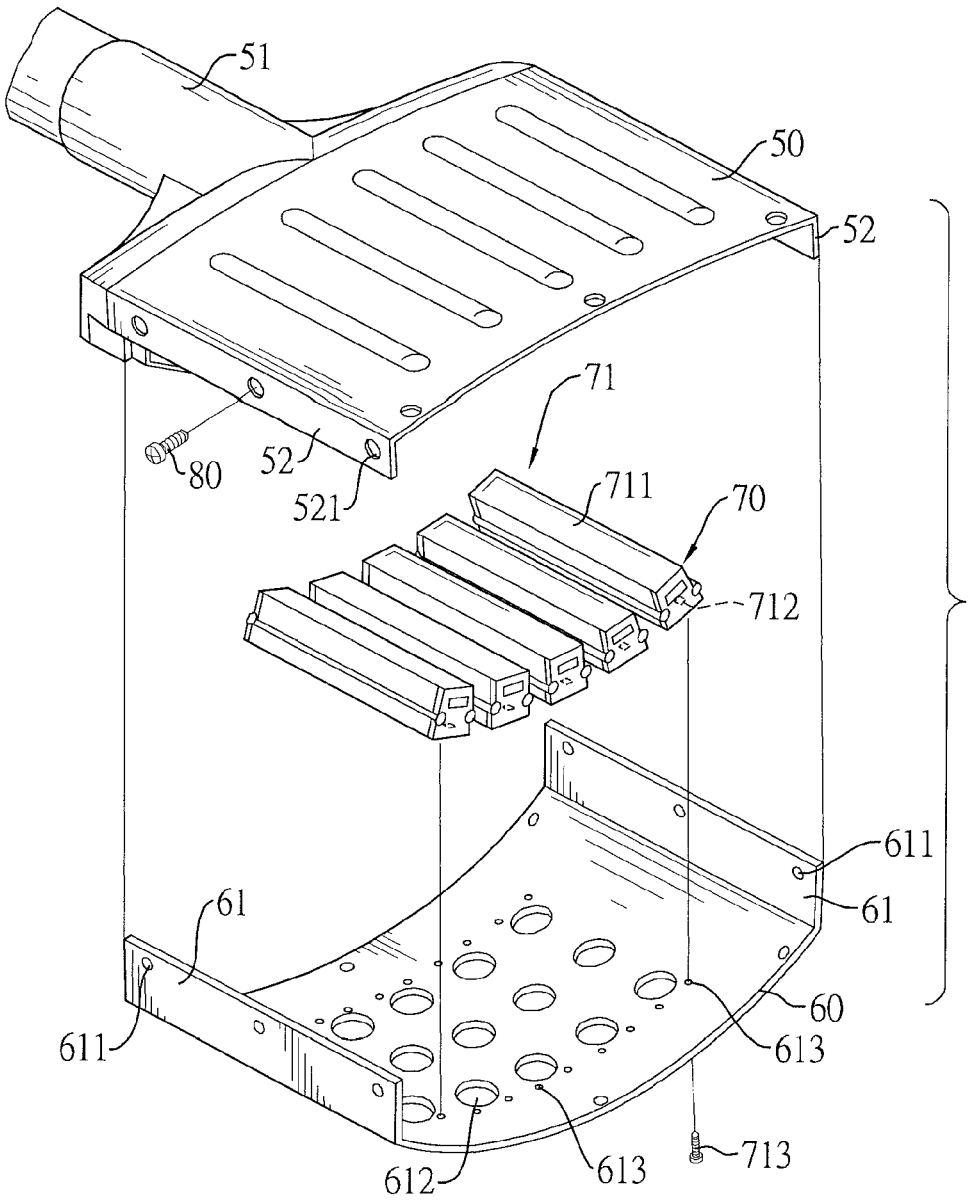
FIG. 6 PRIOR ART
FIG. 6 is a partially exploded perspective view of a conventional LED road light.

The heat sink 10 has a concave profile and has a light opening 101, multiple first sliding slots 11, 11*a*, two first flanges 12 and multiple fins 102. The light opening 101 is rectangular and centrally formed through the heat sink 10. The first sliding slots 11, 11*a* are parallelly formed in a top of the heat sink 10. The two first flanges 12 are respectively formed on and protrude horizontally from two opposite sides of the heat sink 10. Each first flange 12 has multiple first through holes 121 formed therethrough. The fins 102 are formed on and protrude downwardly from a bottom of the heat sink 10. Each first sliding slot 11, 11*a* may have a cross section in a shape of a part of a circle, a point angle, a square or a maple leaf as shown in FIG. 4B.

The LED module 20 is mounted to the light opening 101 of the heat sink 10 to illuminate downwardly through the light opening 101. The LED module 20 has two support brackets 21, a lamp shade 22, a fixing plate 23 and multiple LED elements 24. The two support brackets 21 are respectively mounted on two opposite sidewalls of the rectangular light opening 101. In the present embodiment, the two opposite sidewalls of the light opening 101 are slanted. Each support bracket 21 has a fixing bevel portion 211 and an L-shaped support portion 212. The fixing bevel portion 211 is mounted on one of the slanted sidewalls. The L-shaped support portion 212 is formed on and protrudes downwardly from a bottom of the fixing bevel portion 211 to mount through the light opening 101. The lamp shade 22 is mounted on the two support brackets 21, is curved and made of a glass material and has two lamp flanges 221 respectively formed on and protruding horizontally from two opposite sides of the lamp shade 22. Each lamp flange 221 is mounted on the L-shaped support portion 212 of one of the support brackets 21. The fixing plate 23 is mounted on a bottom of the base 30. The LED elements 24 are mounted on a bottom of the fixing plate 23.

The base 30 has a concave profile and has multiple first sliding ribs 31, 31*a*, multiple second sliding slots 32 and two second flanges 33. The first sliding ribs 31, 31*a* are parallelly formed on and protrude downwardly from the bottom of the base 30 and are slidably and respectively mounted in the first sliding slots 11, 11*a*. The second sliding slots 32 are formed in a top of the base 30. Each first sliding rib 31, 31*a* may have a cross section in a shape of a part of a circle, a point angle, a square or a maple leaf as shown in FIG. 4B. Each second sliding slot 32 may have a cross section in a shape of a part of a circle. The two second flanges 33 are respectively formed on and protrude horizontally from two opposite sides of the base 30. Each second flange 33 has multiple second through holes 331 corresponding respectively to the first through holes 121 in a corresponding one of the first flanges 12 of the heat sink 10. When the first sliding ribs 31, 31*a* are slidably mounted in the first sliding slots 11, 11*a* of the heat sink 10, the base 30 and the heat sink 10 are combined together. At this time, the second flanges 33 are respectively stacked on the first flanges 12. When each first through hole 121 aligns with one of the second through holes 331, a screw is mounted through the first through hole 121 and is screwed into the second through hole 331.

The light pole holder assembly 40 has a first sleeve 42, a second sleeve 43 and a waterproof gasket 44. The first sleeve 42 has multiple second sliding ribs 41 and two locking plates 421. The second sliding ribs 41 are formed on and protrude downwardly from a bottom of the first sleeve 42 and slidably and respectively mounted in the second sliding slots 32 of the base 30. The locking plates 421 are respectively formed on and protrude outwardly and obliquely from two sides of the bottom of the first sleeve 42 and are securely mounted on the top of the base 30. One end of the second sleeve 43 is mounted around one end of the first sleeve 42 and serves to mount and fasten a light pole in the second sleeve 43. The second sleeve 43 has multiple second sliding ribs 41 and two locking plates 431. The second sliding ribs 41 are formed on and protrude downwardly from a bottom of the second sleeve 43 and slidably and respectively mounted in the second sliding slots 32 of the base 30. The two locking plates 431 are respectively formed on and protrude outwardly and obliquely from two sides of the bottom of the second sleeve 43 and are securely mounted on the top of the base 30. The waterproof gasket 44 is mounted and squeezed between the first sleeve 42 and the second sleeve 43.

An assembling process of the rib insertion type LED road light in accordance with the present invention is described as follows.

The lamp shade 22 and the support brackets 21 of the LED module 20 are firstly inserted into the light opening 101 of the heat sink 10. The first sliding ribs 31 on the bottom of the base 30 are respectively aligned with and inserted into the first sliding slots 11 on the top of the heat sink 10 to combine the base 30 with the heat sink 10. Multiple screws are respectively mounted through the first through holes 121 of the first flange 12 and screwed into the second through holes 331 of the second flange 33 to further fasten the heat sink 10 with the base 30. The second sliding ribs 41 on the bottoms of the first sleeve 42 and the second sleeve 43 are then respectively aligned with and inserted into the second sliding slots 32 on the top of the base 30 to combine the light pole holder assembly 40 with the base 30. The locking plates 421, 431 on the top of the base 30 and the second sleeve 43 are screwed together to provide a stable combined strength between the base 30 and the light pole holder assembly 40.

The assembly of the base 30, the heat sink 10 and the light pole holder assembly 40 employs ribs 31, 31*a*, 41 and slots 11, 11*a*, 32 and mounts the ribs 31, 31*a*, 41 into the corresponding sliding slots 11, 11*a*, 32. The contact area of such engagement is relatively larger than that by using screws, thereby enhancing the combined strength of the LED road light. Moreover, such assembly process of the rib 31, 31*a*, 41 and slot 11, 11*a*, 32 is convenient and time-saving to assemble the LED road light.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. An LED road light comprising:

a heat sink having:

a top;

a bottom;

a light opening centrally formed through the heat sink; and multiple first sliding slots formed in the top of the heat sink;

an LED module mounted to the light opening of the heat sink to illuminate downwardly through the light opening;

a base having:

a top;

a bottom;

multiple first sliding ribs formed on and protruding downwardly from the bottom of the base and respectively aligning with and slidably mounted in the first sliding slots on the top of the heat sink; and multiple second sliding slots formed in the top of the base; and a light pole holder assembly having:

a bottom; and multiple second sliding ribs formed on and protruding downwardly form the bottom of the light pole holder assembly and respectively aligning with and slidably mounted in the second sliding slots on the top of the base.

2. The LED road light as claimed in claim 1, wherein each first sliding slot and each first sliding rib have a cross section in a shape of a part of a circle, and each second sliding slot and each second sliding rib have a cross section in a shape of a part of a circle.

3. The LED road light as claimed in claim 2, wherein the heat sink has a concave profile and has two first flanges respectively formed on and protruding horizontally from two opposite sides of the heat sink, each first flange has multiple first through holes formed through the first flange, and the light opening is rectangular; and the base has a concave profile and has two second flanges respectively formed on and protruding horizontally from two opposite sides of the base, and each second flange has multiple second through holes formed through the second flange.

4. The LED road light as claimed in claim 2, wherein the light opening is rectangular and has four sidewalls; and the LED module has:

two support brackets respectively mounted on two opposite sidewalls of the light opening;

a lamp shade mounted on the two support brackets;

a fixing plate mounted on the bottom of the base and having a bottom; and multiple LED elements mounted on the bottom of the fixing plate.

5. The LED road light as claimed in claim 3, wherein the light opening has four sidewalls; and the LED module has:

two support brackets respectively mounted on two opposite sidewalls of the light opening;

a lamp shade mounted on the two support brackets;

a fixing plate mounted on the bottom of the base and having a bottom; and multiple LED elements mounted on the bottom of the fixing plate.

6. The LED road light as claimed in claim 5, wherein the light opening has two opposite sidewalls being slanted;

each support bracket has:

a fixing bevel portion mounted on one of the slanted sidewalls; and an L-shaped support portion formed on and protruding downwardly from a bottom of the fixing bevel portion to mount through the light opening; and the lamp shade is curved and has two lamp flanges respectively formed on and protruding horizontally from two opposite sides of the lamp shade and each lamp flange is mounted on the L-shaped support portion of one of the support brackets.

7. The LED road light as claimed in claim 6, wherein the light pole holder assembly has:

a first sleeve having:

a bottom;

multiple second sliding ribs formed on and protruding downwardly from the bottom of the first sleeve and slidably and respectively mounted in the second sliding slots of the base;

a second sleeve having:

a bottom;

multiple second sliding ribs formed on and protruding downwardly from the bottom of the second sleeve and slidably and respectively mounted in the second sliding slots of the base; and one end mounted around one end of the first sleeve; and a waterproof gasket mounted and squeezed between the first sleeve and the second sleeve.

8. The LED road light as claimed in claim 7, wherein each one of the first sleeve and the second sleeve has two locking plates respectively formed on and protruding outwardly and obliquely from two sides of the bottom of the first sleeve and securely mounted on the top of the base.

9. The LED road light as claimed in claim 2, wherein the light opening is rectangular and has four sidewalls, and two opposite sidewalls are slanted;

each support bracket has:

a fixing bevel portion mounted on one of the slanted sidewalls; and an L-shaped support portion formed on and protruding downwardly from a bottom of the fixing bevel portion to mount through the light opening; and the lamp shade is curved and has two lamp flanges respectively formed on and protruding horizontally from two opposite sides of the lamp shade and each lamp flange is mounted on the L-shaped support portion of one of the support brackets.

10. The LED road light as claimed in claim 2, wherein the heat sink has multiple fins formed on and protruding downwardly from the bottom of the heat sink.

11. The LED road light as claimed in claim 1, wherein each first sliding slot and each first sliding rib have a cross section in a shape of a point angle, and each second sliding slot and each second sliding rib have a cross section in a shape of a part of a circle.

12. The LED road light as claimed in claim 11, wherein the heat sink has a concave profile and has two first flanges respectively formed on and protruding horizontally from two opposite sides of the heat sink, each first flange has multiple first through holes formed through the first flange, and the light opening is rectangular; and the base has a concave profile and has two second flanges respectively formed on and protruding horizontally from two opposite sides of the base, and each second flange has multiple second through holes formed through the second flange.

13. The LED road light as claimed in claim 12, wherein the light opening has four sidewalls; and the LED module has:

two support brackets respectively mounted on two opposite sidewalls of the light opening;

a lamp shade mounted on the two support brackets;

a fixing plate mounted on the bottom of the base and having a bottom; and multiple LED elements mounted on the bottom of the fixing plate.

14. The LED road light as claimed in claim 13, wherein the light opening has two opposite sidewalls being slanted;

each support bracket has:

a fixing bevel portion mounted on one of the slanted sidewalls; and an L-shaped support portion formed on and protruding downwardly from a bottom of the fixing bevel portion to mount through the light opening; and the lamp shade is curved and has two lamp flanges respectively formed on and protruding horizontally from two opposite sides of the lamp shade and each lamp flange is mounted on the L-shaped support portion of one of the support brackets.

15. The LED road light as claimed in claim 14, wherein the light pole holder assembly has:

a first sleeve having:

a bottom;

multiple second sliding ribs formed on and protruding downwardly from the bottom of the first sleeve and slidably and respectively mounted in the second sliding slots of the base;

a second sleeve having:

a bottom;

multiple second sliding ribs formed on and protruding downwardly from the bottom of the second sleeve and slidably and respectively mounted in the second sliding slots of the base; and one end mounted around one end of the first sleeve; and a waterproof gasket mounted and squeezed between the first sleeve and the second sleeve.

16. The LED road light as claimed in claim 15, wherein each one of the first sleeve and the second sleeve has two locking plates respectively formed on and protruding outwardly and obliquely from two sides of the bottom of the first sleeve and securely mounted on the top of the base.

17. The LED road light as claimed in claim 11, wherein the light opening is rectangular and has four sidewalls; and the LED module has:

two support brackets respectively mounted on two opposite sidewalls of the light opening;

a lamp shade mounted on the two support brackets;

a fixing plate mounted on the bottom of the base and having a bottom; and multiple LED elements mounted on the bottom of the fixing plate.

18. The LED road light as claimed in claim 11, wherein the light opening is rectangular and has four sidewalls, and two opposite sidewalls are slanted;

each support bracket has:

a fixing bevel portion mounted on one of the slanted sidewalls; and an L-shaped support portion formed on and protruding downwardly from a bottom of the fixing bevel portion to mount through the light opening; and the lamp shade is curved and has two lamp flanges respectively formed on and protruding horizontally from two opposite sides of the lamp shade and each lamp flange is mounted on the L-shaped support portion of one of the support brackets.

19. The LED road light as claimed in claim 11, wherein the heat sink has multiple fins formed on and protruding downwardly from the bottom of the heat sink.

20. The LED road light as claimed in claim 1, wherein the heat sink has a concave profile and has two first flanges respectively formed on and protruding horizontally from two opposite sides of the heat sink, each first flange has multiple first through holes formed through the first flange, and the light opening is rectangular; and the base has a concave profile and has two second flanges respectively formed on and protruding horizontally from two opposite sides of the base, and each second flange has multiple second through holes formed through the second flange.

21. The LED road light as claimed in claim 20, wherein the light opening has four sidewalls; and the LED module has:

two support brackets respectively mounted on two opposite sidewalls of the light opening;

a lamp shade mounted on the two support brackets;

a fixing plate mounted on the bottom of the base and having a bottom; and multiple LED elements mounted on the bottom of the fixing plate.

22. The LED road light as claimed in claim 21, wherein the light opening has two opposite sidewalls being slanted;

each support bracket has:

a fixing bevel portion mounted on one of the slanted sidewalls; and an L-shaped support portion formed on and protruding downwardly from a bottom of the fixing bevel portion to mount through the light opening; and the lamp shade is curved and has two lamp flanges respectively formed on and protruding horizontally from two opposite sides of the lamp shade and each lamp flange is mounted on the L-shaped support portion of one of the support brackets.

23. The LED road light as claimed in claim 22, wherein the light pole holder assembly has:

a first sleeve having:

a bottom;

multiple second sliding ribs formed on and protruding downwardly from the bottom of the first sleeve and slidably and respectively mounted in the second sliding slots of the base;

a second sleeve having:

a bottom;

multiple second sliding ribs formed on and protruding downwardly from the bottom of the second sleeve and slidably and respectively mounted in the second sliding slots of the base; and one end mounted around one end of the first sleeve; and a waterproof gasket mounted and squeezed between the first sleeve and the second sleeve.

24. The LED road light as claimed in claim 23, wherein each one of the first sleeve and the second sleeve has two locking plates respectively formed on and protruding outwardly and obliquely from two sides of the bottom of the first sleeve and securely mounted on the top of the base.

25. The LED road light as claimed in claim 1, wherein the light opening is rectangular and has four sidewalls; and the LED module has:

two support brackets respectively mounted on two opposite sidewalls of the light opening;

a lamp shade mounted on the two support brackets;

a fixing plate mounted on the bottom of the base and having a bottom; and multiple LED elements mounted on the bottom of the fixing plate.

26. The LED road light as claimed in claim 1, wherein the light opening is rectangular and has four sidewalls, and two opposite sidewalls are slanted;

each support bracket has:

a fixing bevel portion mounted on one of the slanted sidewalls; and an L-shaped support portion formed on and protruding downwardly from a bottom of the fixing bevel portion to mount through the light opening; and the lamp shade is curved and has two lamp flanges respectively formed on and protruding horizontally from two opposite sides of the lamp shade and each lamp flange is mounted on the L-shaped support portion of one of the support brackets.

27. The LED road light as claimed in claim 1, wherein the heat sink has multiple fins formed on and protruding downwardly from the bottom of the heat sink.

* * * * *